US010028594B2

(12) United States Patent
Anderson et al.

(10) Patent No.: US 10,028,594 B2
(45) Date of Patent: Jul. 24, 2018

(54) MERCHANDISER WITH MERGED AIR DISCHARGE

(71) Applicant: Hussmann Corporation, Bridgeton, MO (US)

(72) Inventors: Timothy D. Anderson, St. Louis, MO (US); Ken Nguyen, St. Louis, MO (US); Paul R. Laurentius, Maryland Heights, MO (US)

(73) Assignee: Hussmann Corporation, Bridgeton, MO (US)

( * ) Notice: Subject to any disclaimer, the term of this patent is extended or adjusted under 35 U.S.C. 154(b) by 1168 days.

(21) Appl. No.: 13/794,946

(22) Filed: Mar. 12, 2013

(65) Prior Publication Data

US 2014/0260374 A1 Sep. 18, 2014

(51) Int. Cl.
*A47F 3/04* (2006.01)

(52) U.S. Cl.
CPC ..... *A47F 3/0447* (2013.01)

(58) Field of Classification Search
CPC .... A47F 3/0447; A47F 3/0439; A47F 3/0443; A47F 3/04
USPC ... 62/255, 524, 251, 256, 96, 246, 408, 314, 62/454, 89, 97, 413; 454/190–193
See application file for complete search history.

(56) References Cited

U.S. PATENT DOCUMENTS 3,369,375 A * 2/1968 Gerweck et al. ..... 62/256
3,935,803 A * 2/1976 Bush ..... 454/189
4,283,922 A * 8/1981 Subera et al. ..... 62/256
4,807,446 A 2/1989 Sunaga
4,938,034 A * 7/1990 Rosanio et al. ..... 62/256

FOREIGN PATENT DOCUMENTS

JP 6003030 1/1994
WO 2010068367 6/2010

OTHER PUBLICATIONS

First Office Action from the Australian Patent Office for application No. 2013204123 dated Jan. 7, 2015 (5 pages).

* cited by examiner

*Primary Examiner* — Len Tran
*Assistant Examiner* — Ana Vazquez
(74) *Attorney, Agent, or Firm* — Michael Best & Friedrich LLP

(57) ABSTRACT

A merchandiser including a case that defines a product display area. The case includes a canopy that has a first air outlet in fluid communication with a primary air passageway within the case to direct a primary air curtain into the product display area, and a second air outlet in fluid communication with a secondary air passageway within the case to direct a secondary air curtain into the product display area. The merchandiser also includes a divider that is coupled to the canopy between the primary air passageway and the secondary air passageway. The divider provides airflow communication between the primary air passageway and the secondary air passageway upstream of the first and second air outlets.

20 Claims, 4 Drawing Sheets

MERCHANDISER WITH MERGED AIR DISCHARGE

BACKGROUND

The present invention relates to merchandisers, and more particularly, to merchandisers including multiple air curtains for conditioning product display areas.

In conventional practice, supermarkets and convenience stores are equipped with refrigerated merchandisers, which may be open or provided with doors, for presenting fresh food or beverages to customers while maintaining the fresh food and beverages in a refrigerated environment or product display area. Typically, a refrigerated airflow is directed through the merchandiser and is discharged from an air discharge or outlet to condition product supported in the product display area. Some existing merchandisers include two or more air passageways to direct refrigerated and/or non-refrigerated airflows through the case and discharge the airflows from the merchandiser in the form of discrete air curtains In existing merchandisers, the discrete air curtains generate a turbulent boundary layer between the primary and secondary curtains, which causes the airflows to mix after the discharge point. This post-discharge mixing causes warm air to infiltrate into the case.

SUMMARY

In one construction, the invention provides a merchandiser including a case that defines a product display area. The case includes a canopy that has a first air outlet in fluid communication with a primary air passageway within the case to direct a primary air curtain into the product display area, and a second air outlet in fluid communication with a secondary air passageway within the case to direct a secondary air curtain into the product display area. The merchandiser also includes a divider that is coupled to the canopy between the primary air passageway and the secondary air passageway. The divider provides airflow communication between the primary air passageway and the secondary air passageway upstream of the first and second air outlets.

In another construction, the invention provides a method of operating a merchandiser that has a case defining a product display area. The method includes generating a primary airflow through a primary air passageway of the case, discharging the primary airflow from the case through an outlet in the form of a primary air curtain; generating a secondary airflow through a secondary air passageway of the case, and discharging a secondary airflow from the case through the outlet in the form of a secondary air curtain. The method also includes merging a portion of the primary airflow and the secondary airflow to define a merged air curtain, and discharging the merged air curtain through at least one of the first and second outlets alongside the primary and secondary air curtains.

In another construction, the invention provides a merchandiser including a case that defines a product display area. The case includes a canopy that has an air outlet in fluid communication with a primary air passageway within the case to direct a primary air curtain into the product display area. The air outlet is further in fluid communication with a secondary air passageway within the case to direct a secondary air curtain into the product display area. The merchandiser also includes a louver that is disposed over the air outlet, and a divider that is coupled to the canopy between the primary air passageway and the secondary air passageway. The divider is positioned adjacent the louver and provides airflow communication between the primary air passageway and the secondary air passageway upstream of the louver.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
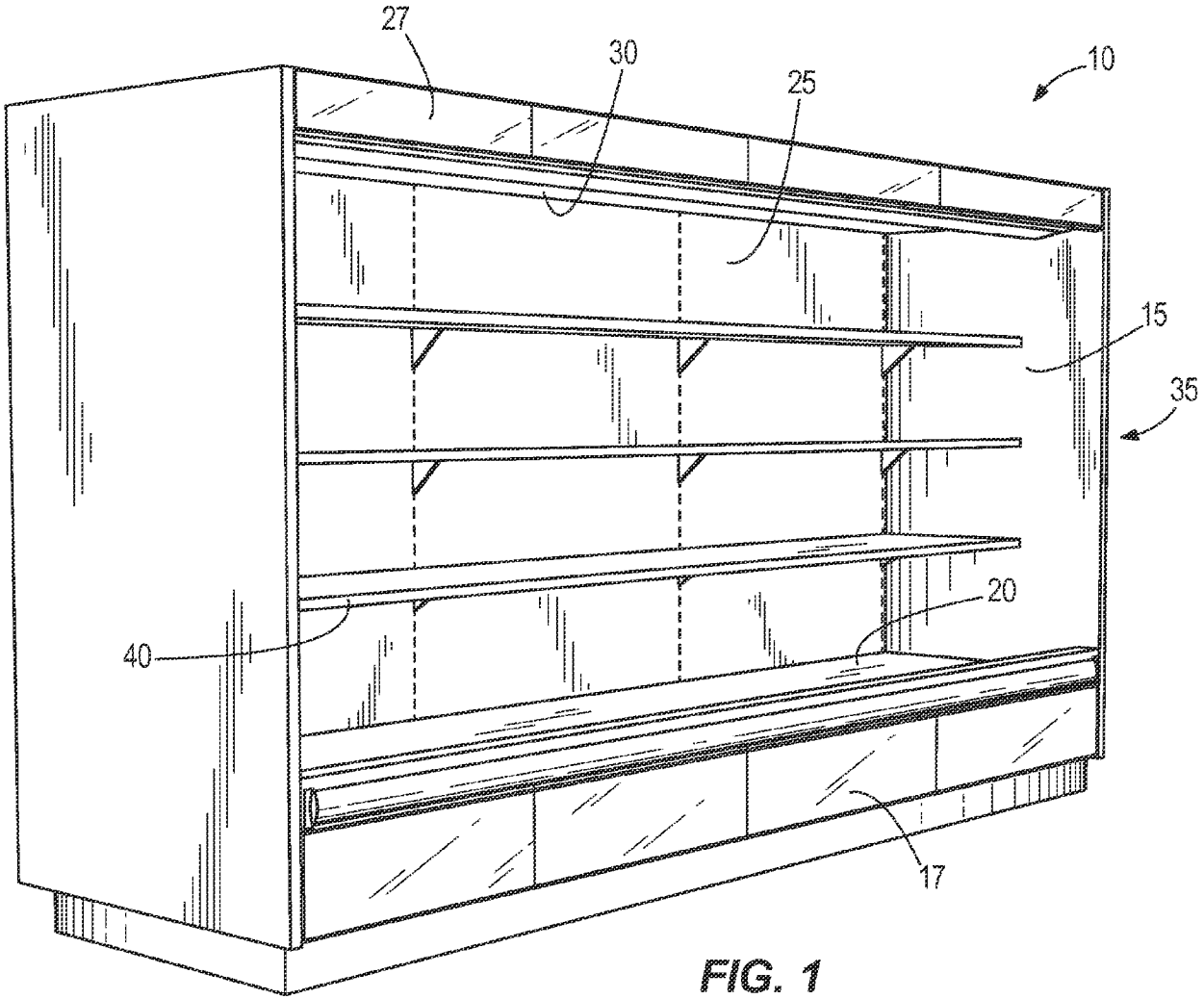
FIG. 1 is a perspective view of a refrigerated merchandiser.

FIG. 1 shows a refrigerated merchandiser 10 that may be located in a supermarket or a convenience store for presenting food product (e.g., fresh food and/or beverages, etc.) to customers. The refrigerated merchandiser 10 includes a case 15 that has a base 17 defining an interior bottom wall 20, a first interior rear wall 25, a canopy 27 defining a first interior top wall 30, and an open front face to allow customers access to the food product stored in the case 15. The area bounded by the interior bottom wall 20, the first interior rear wall 25, and the first interior top wall 30 defines a product display area 35. The food product is stored on one or more shelves 40 in the product display area 35. The illustrated construction shows an upright merchandiser 10, although the merchandiser 10 can be a horizontal merchandiser (e.g., "coffin"-style). Also, while the illustrated merchandiser 10 is an open-front merchandiser, the product display area 35 can be enclosed by one or more doors.

Figure 2:
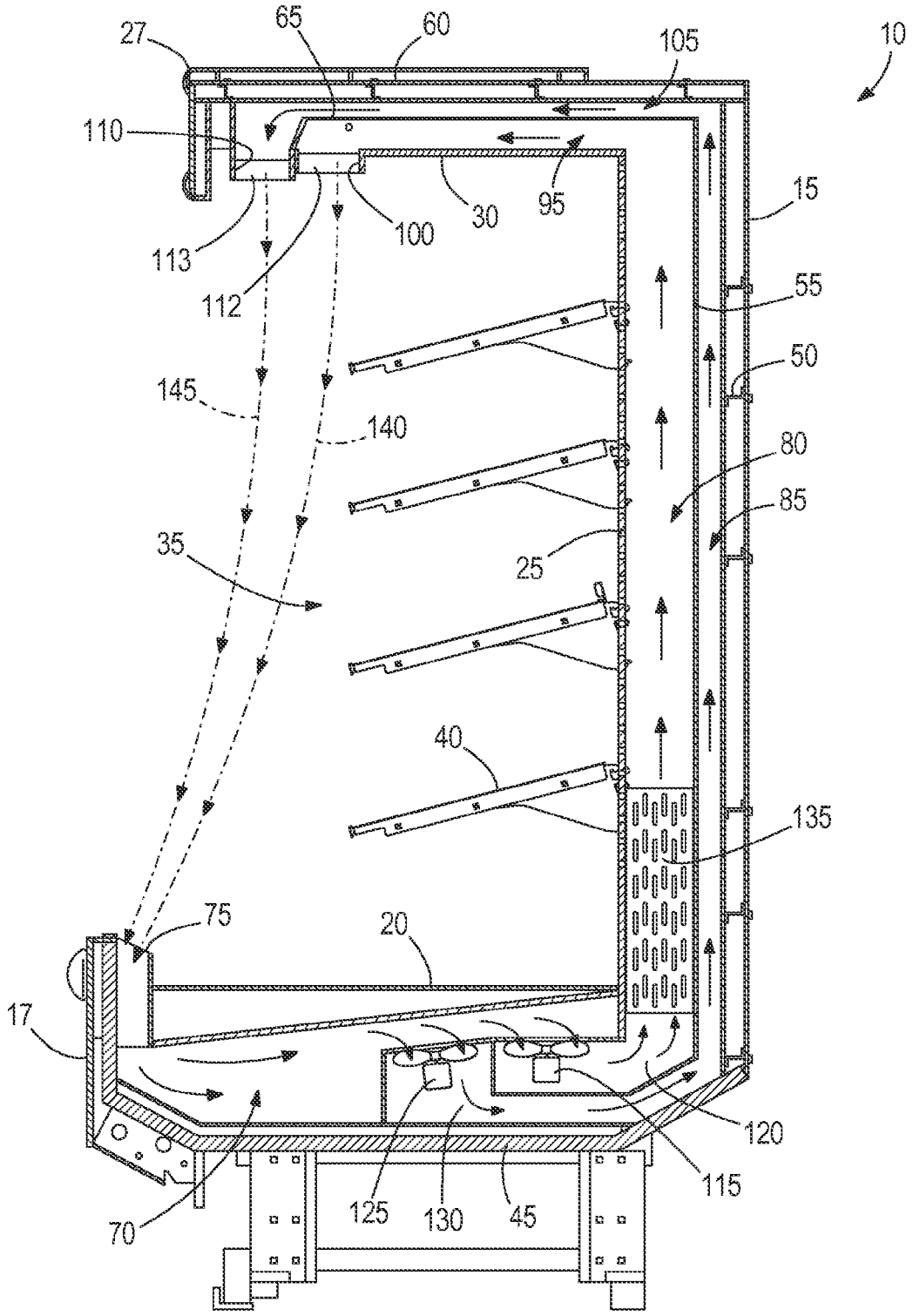
FIG. 2 is a side view of the refrigerated merchandiser of FIG. 1.

With reference to FIG. 2, the case 15 further includes an exterior bottom wall 45, an exterior rear wall 50, a second interior rear wall 55 disposed between the first interior rear wall 25 and the exterior rear wall 50, an exterior top wall 60, and a second interior top wall 65 disposed between the first interior top wall 30 and the exterior top wall 60. A lower flue 70 is defined by the interior and exterior bottom walls 20, 45 to allow a substantially horizontal airflow throughout the lower flue 70. The interior bottom wall 20 includes an opening or inlet 75 adjacent the lower flue 70 to so air can be drawn into the lower flue 70.

A primary rear flue 80 is defined by the first interior rear wall 25 and the second interior rear wall 55, and a secondary rear flue 85 is defined by the exterior rear wall 50 and the second interior rear wall 55. The primary and secondary rear flues 80, 85 are fluidly connected with the lower flue 70 to allow separate, substantially vertical airflow throughout the primary and secondary rear flues 80, 85.

Figure 3:
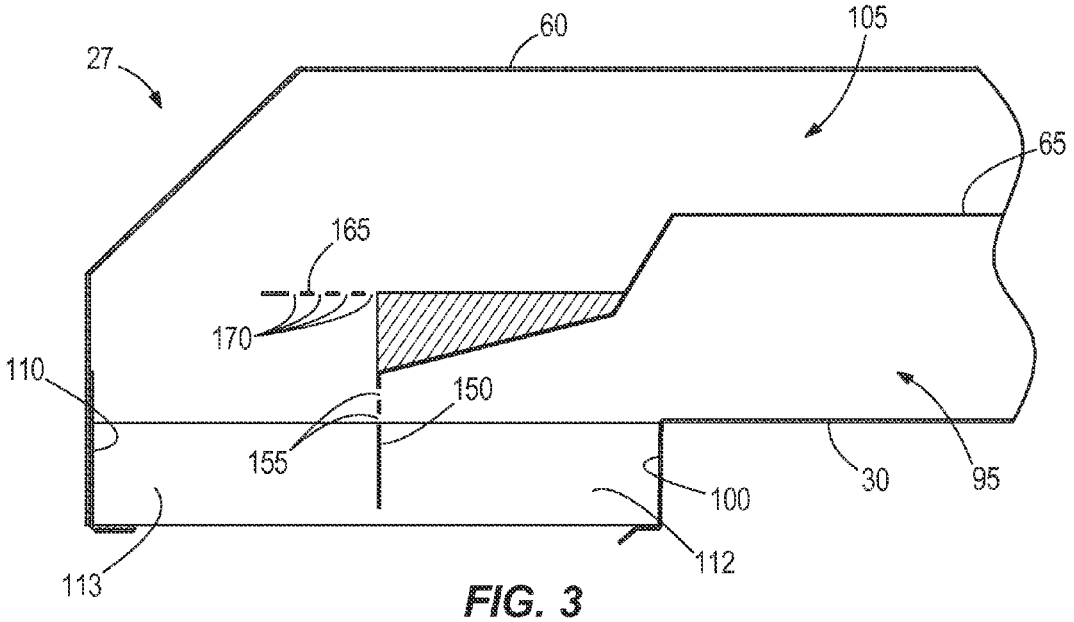
FIG. 3 is a schematic of a canopy of the refrigerated merchandiser.
Figure 5:
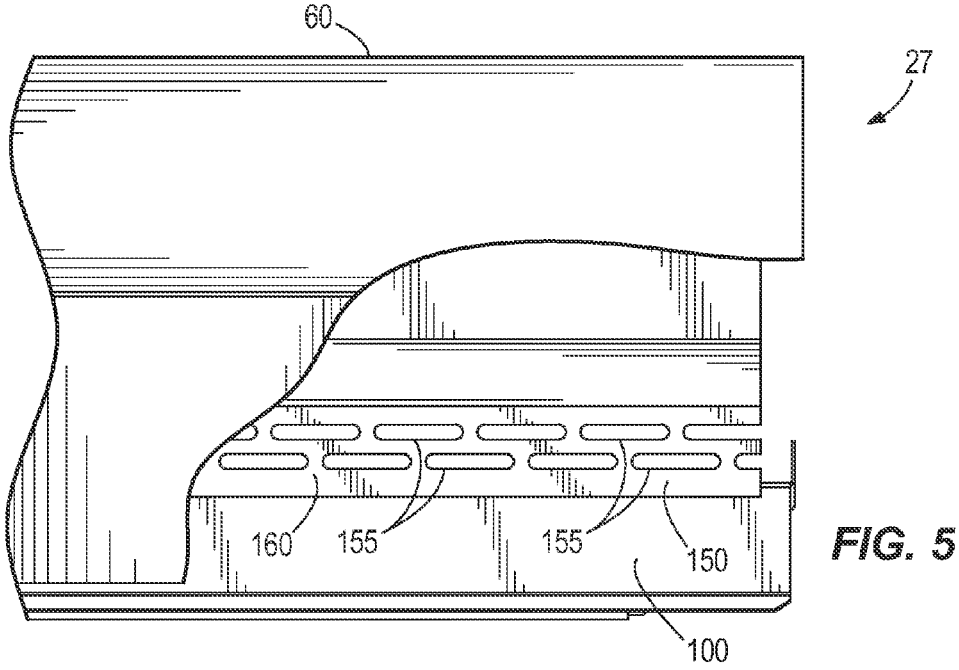
FIG. 5 is a front view of a portion of the canopy of FIG. 4 illustrating the airflow divider.

The canopy 27 has a primary upper flue 95 that is defined by the first interior top wall 30 and the second interior top wall 65. The primary upper flue 95 is connected to the primary rear flue 80 and is in airflow communication with a primary opening or air outlet 100 located adjacent the open front of the case 15. The canopy 27 also has a secondary upper flue 105 that is defined by the exterior top wall 60 and the second interior top wall 65. The secondary upper flue 105 is connected to the secondary rear flue 85 and is in airflow communication with a secondary opening or air outlet 110. The primary and secondary upper flues 95, 105 allow substantially horizontal airflow through the canopy 27 toward the primary and secondary air outlets 100, 110. With reference to FIGS. 3 and 5, a primary louver 112 (e.g., honeycomb) is positioned over the primary outlet 100, and a secondary louver 113 (e.g., honeycomb) is positioned over the secondary outlet 110 to guide air into the product display area 35. In some constructions, the merchandiser 10 can include a unitary louver 112 extending across the outlets 100, 110.

The refrigerated merchandiser 10 also includes some components of a refrigeration system (not entirely shown). As illustrated, the merchandiser 10 includes a first fan 115 disposed in the lower flue 70 (the fan 115 can be located in the primary rear flue 80 or the primary upper flue 95) to generate airflow through the primary rear flue 80 and the primary upper flue 95. The first fan 115 forces air into a first fan plenum 120 downstream of the first fan 115 and upstream of the primary rear flues 80. The first fan plenum 120 provides pressurized airflow to the primary air passageways. A second fan 125 is located within the lower flue 70 (e.g., forward of the first fan 115) to generate airflow through the secondary rear flue 85 and the secondary upper flue 105. The second fan 125 forces air into a second fan plenum 130 downstream of the second fan 125 and upstream of the secondary rear flues 85. The second fan plenum 130 provides pressurized airflow to the secondary air passageways. In other constructions, the first fan 115 and second fan 125 may be replaced with a single fan located within the lower flue 70 with a corresponding single fan plenum to generate airflow through both the primary and secondary air passageways. Other locations for the first fan 115 and second fan 125 are also contemplated (e.g., located in the respective rear flues 80, 85 or upper flues 95, 105).

An evaporator 135 is located within the primary rear flue 80 and downstream of the first fan plenum 120. The evaporator 135 is configured to receive a saturated refrigerant which has passed through an expansion valve (not shown). As is known in the art, the saturated refrigerant is evaporated as it passes through the evaporator 135 as a result of absorbing heat from the airflow passing over the evaporator 135. The evaporator 135 allows the temperature of the airflow to decrease as the airflow passes over the evaporator 135. The heated or gaseous refrigerant then exits the evaporator 135 and is pumped back to remotely located compressor(s) for re-processing into the refrigeration system. As shown in FIG. 2, no cooling structure is provided in the secondary rear flue 85 such that cool airflow entering the lower flue 70 is directed through the second fan plenum 130.

With reference to FIG. 2, the primary rear flue 80 and the primary upper flue 95 define a primary air passageway to conduct refrigerated airflow through the primary outlet 100 in the form of a primary air curtain 140. The primary air curtain 140 is adjacent the product display area 35 to directly cool the food product. For example, the primary air curtain can be maintained at about 33 degrees Fahrenheit to cool the product display area 35.

The secondary rear flue 85 and the secondary upper flue 105 define a secondary air passageway to conduct cool airflow through the secondary outlet 110 in the form of a secondary air curtain 145. The secondary air curtain 120 is adjacent and outside of the primary air curtain 115 to assist in forming a barrier between the outside of the case and the product display area 35. The secondary air curtain 120 is warmer than the primary air curtain 115 and cooler than ambient air surrounding the refrigerated merchandiser 10. In one construction, the secondary air curtain 120 is maintained between about 43 and 45 degrees Fahrenheit. Other constructions may include the secondary air curtain at temperatures below 43 degrees Fahrenheit or above 45 degrees Fahrenheit.

With reference to FIGS. 3-6, an airflow divider 150 is coupled to the canopy 27 above the primary and secondary outlets 100, 110. As illustrated, the divider 150 defines a portion of the primary and secondary air passageways and impinges on the top side of the louvers 112, 113. The divider 150 can be formed as part of the second interior top wall 65, or coupled to an end of the second interior top wall 65 (e.g., by fasteners). The illustrated divider 150 is oriented substantially vertically within the canopy 27 above the louvers 112, 113, although the divider 150 can be disposed in a non-vertical angular orientation. The divider 150 extends the length of the canopy 27, although the divider 150 can be shorter than the length of the canopy 27.

Figure 4:
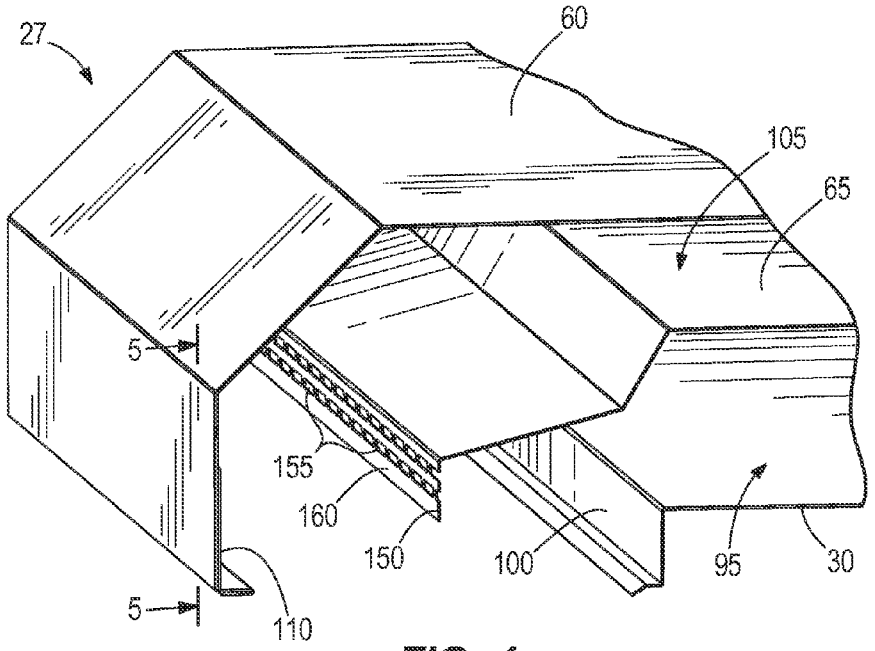
FIG. 4 is a perspective view of a portion of the canopy including an airflow divider and with some of the components illustrated in FIG. 3 removed for clarity.

As illustrated in FIGS. 3-6, the divider 150 separates the primary air passageway from the secondary air passageway and includes holes or perforations 155 (illustrated schematically in FIGS. 3 and 6) that provide airflow communication between the primary and secondary air passageways. With reference to FIGS. 4 and 5, the illustrated divider 150 includes a plate 160 and the perforations 155 are positioned on the divider 150 in two rows extending the length of the plate 160. In some constructions, the perforations 155 can be positioned sporadically along the length of the plate 160, spaced evenly along the length of the plate 160, or positioned along one or more discrete portions of the plate 160. Also, while the illustrated perforations 155 are ovular, the perforations 155 can have any suitable shape (e.g., circular, rectangular or other polygonal shape, slits, etc.).

With reference to FIG. 3, the canopy 27 also includes an airflow guide 165 that extends generally across the direction of airflow within the passageway. As illustrated, the air flow guide 165 extends outward from an area adjacent the second interior upper wall 65 generally forward into the secondary air passageway. The airflow guide 165 has perforations or holes 170 (illustrated schematically in FIG. 3) that restrictively permits airflow within the secondary passageway through the guide 165 to generate a substantially laminar flow of air from the secondary outlet 110. That is, some airflow in the secondary air passageway is disrupted by the airflow guide 165 and filters through the airflow guide 165 while the remaining portion of the airflow passes around the airflow guide 165 so that a substantially vertical airflow exits the outlet 110. In this manner, the perforations 155 and the holes 170 cooperatively define a substantially laminar airflow exiting the outlet 110.

Figure 6:
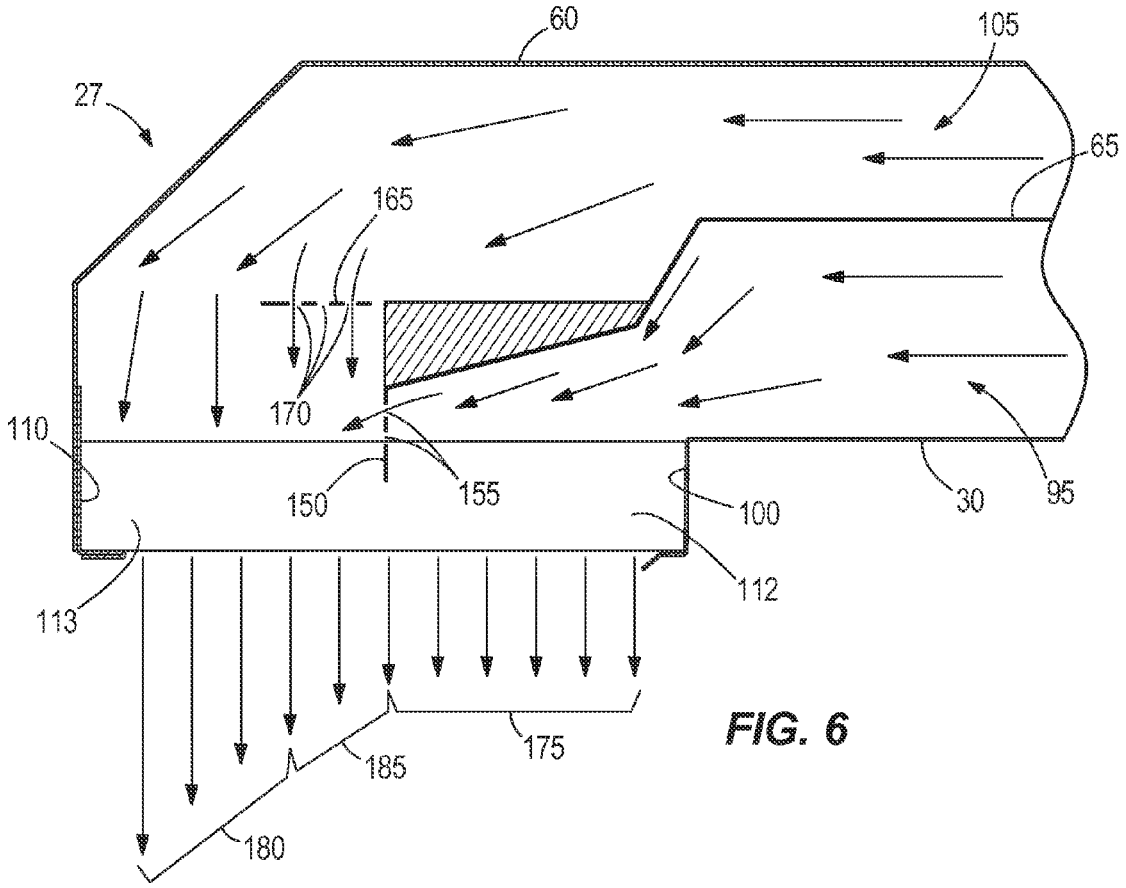
FIG. 6 is a schematic of the canopy illustrating airflow profiles exiting the canopy.

With reference to FIG. 6, the primary air curtain 140 exiting the outlet 100 has a first airflow profile (depicted by arrows 175) that is defined by a first air temperature and velocity. Similarly, the secondary air curtain 145 has a second airflow profile (depicted by arrows 180) that is defined by a second air temperature and velocity across a substantial portion of the outlet 110. The second airflow profile 180 is warmer and faster than the first airflow profile, although the relative profile can be modified, if desired. The perforated divider 150 mixes or merges some of the air from the primary air passageway with air in the secondary air passageway upstream of the outlets 100, 110 such that the merged air defines a portion of the secondary air curtain 145 adjacent the primary air curtain 140. Stated another way, the merged airflow exiting the second outlet 100 adjacent and below the divider 150 defines a merged air curtain section that has a third airflow profile (depicted by arrows 185) with a temperature and velocity between the temperatures and velocities of the first and second airflow profiles. As illustrated, the first, second, and third airflow profiles 175, 180, 185 generate an overall airflow profile across the first outlets 100, 110 that uniformly increases in at least one of temperature and velocity from adjacent an interior side of the outlet 100 to an exterior side of the canopy 27.

Merging the airflow upstream of the outlets 100, 110 reduces, or possibly eliminates a turbulent boundary layer between the primary and secondary air curtains 140, 145. Reducing or eliminating turbulence within or between the air curtains 140, 145 increases the distance that a laminar airflow extends into the product display area 35, which in turn reduces or inhibits entrainment of ambient air into the air curtains 140, 145. Also, the divider 150 and other portions of the merchandiser 10 can be modified, if desired, to provide airflow profiles other than the first, second, and third airflow profiles illustrated in FIG. 6.

Various features and advantages of the invention are set forth in the following claims.

The invention claimed is:

1. A merchandiser comprising:

a case defining a product display area and including a canopy having a first air outlet in fluid communication with a primary air passageway within the case to direct a primary air curtain into the product display area, the canopy further having a second air outlet in fluid communication with a secondary air passageway within the case to direct a secondary air curtain into the product display area;

a divider coupled to the canopy between the primary air passageway and the secondary air passageway, the divider providing airflow communication between the primary air passageway and the secondary air passageway upstream of the first and second air outlets, the airflow communication provided through the divider; and a wall extending through the canopy to the divider to maintain air separation between the primary air passageway and the secondary air passageway upstream from the divider.

2. The merchandiser of claim 1, wherein the divider defines a portion of the primary and secondary air passageways.

3. The merchandiser of claim 1, wherein the divider includes one or more perforations spaced along the divider.

4. The merchandiser of claim 1, wherein air exiting the canopy adjacent the divider defines a merged air curtain comprised of air from the primary air passageway and air from the secondary air passageway.

5. The merchandiser of claim 4, wherein the primary air curtain is a refrigerated air curtain and the secondary air curtain is warmer than the primary air curtain.

6. The merchandiser of claim 4, wherein the primary air curtain is defined by a first airflow profile having a temperature and velocity and the secondary air curtain is defined by a second airflow profile having a temperature and velocity different from the first airflow profile, and wherein the merged air curtain is defined by a third airflow profile having a temperature and velocity between the temperature and velocity of the first and second airflow profiles.

7. The merchandiser of claim 1, wherein the divider includes a plate and a plurality of perforations are defined along the length of the plate.

8. The merchandiser of claim 1, further comprising a louver positioned over the first and second air outlets, and wherein the divider has a plurality of perforations directly above the louver.

9. The merchandiser of claim 1, wherein the divider includes a plate and a plurality of perforations are defined along at least a portion of the length of the plate.

10. A method of operating a merchandiser having a case defining a product display area, the method comprising:

generating a primary airflow through a primary air passageway of the case;

discharging the primary airflow from the case through an outlet in the form of a primary air curtain;

generating a secondary airflow through a secondary air passageway of the case;

discharging the secondary airflow from the case through the outlet in the form of a secondary air curtain;

merging a portion of the primary airflow and the secondary airflow through a divider upstream of the outlet to define a merged air curtain;

discharging the merged air curtain through the outlet alongside the primary and secondary air curtains; and wherein the secondary airflow is kept separate from the primary airflow upstream of the merger.

11. The method of claim 10, further comprising refrigerating the primary airflow.

12. The method of claim 10, further comprising discharging the merged air curtain between the primary and secondary air curtains.

13. The method of claim 10, further comprising generating an airflow profile across the outlet that uniformly increases in at least one of temperature and velocity.

14. A merchandiser comprising:

a case defining a product display area and including a canopy having an air outlet in fluid communication with a primary air passageway within the case to direct a primary air curtain into the product display area, the air outlet further in fluid communication with a secondary air passageway within the case to direct a secondary air curtain into the product display area;

a divider coupled to the canopy between the primary air passageway and the secondary air passageway, the divider providing airflow communication between the primary air passageway and the secondary air passageway upstream of the air outlet; and a wall extending rearward from the divider to maintain air separation between the primary air passageway and the secondary air passageway upstream from the divider.

15. The merchandiser of claim 14, wherein the divider defines a portion of the primary and secondary air passageways.

16. The merchandiser of claim 14, wherein the divider includes one or more perforations spaced along the divider.

17. The merchandiser of claim 16, further comprising an airflow guide including a plurality of holes and positioned in the secondary air passageway to partially disrupt airflow within the secondary air passageway, and wherein the divider and the airflow guide cooperatively provide a substantially laminar airflow exiting the outlet.

18. The merchandiser of claim 17, wherein air exiting the canopy adjacent the divider defines a merged air curtain comprised of air from the first air passageway and air from the second air passageway.

19. The merchandiser of claim 18, wherein the primary air curtain is defined by a first airflow profile having a temperature and velocity and the secondary air curtain is defined by a second airflow profile having a temperature and velocity different from the first airflow profile, and wherein the merged air curtain is defined by a third airflow profile having a temperature and velocity between the temperature and velocity of the first and second airflow profiles.

20. The merchandiser of claim 14, further comprising a louver disposed over the outlet, wherein the divider is engaged with a top of the louver.

* * * * *